US006588486B1

(12) United States Patent
Takayama et al.

(10) Patent No.: US 6,588,486 B1
(45) **Date of Patent: *Jul. 8, 2003**

(54) METERING METHOD OF METAL MATERIAL IN INJECTION MOLDING

(75) Inventors: Kazutoshi Takayama, Nagano-ken (JP); Toshiyasu Koda, Nagano-ken (JP); Yasuhiko Takeuchi, Nagano-ken (JP); Takahiro Kobayashi, Nagano-ken (JP); Yuji Hayashi, Nagano-ken (JP); Mamoru Miyagawa, Nagano-ken (JP)

(73) Assignee: Nissei Plastic Industrial Co., Ltd., Nagano-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/672,389

(22) Filed: Sep. 28, 2000

(30) Foreign Application Priority Data

Sep. 30, 1999 (JP) ..... 11-279362

(51) Int. Cl.[7] ..... B22D 17/00
(52) U.S. Cl. ..... 164/113; 164/312
(58) Field of Search ..... 164/113, 303, 164/312, 316, 317, 900, 150.1

(56) References Cited

U.S. PATENT DOCUMENTS 5,040,589 A * 8/1991 Bradley et al. ..... 164/113
5,143,736 A * 9/1992 Kumamura et al. ..... 425/567
5,501,266 A * 3/1996 Wang et al. ..... 164/113
5,601,136 A * 2/1997 Shimmell ..... 164/312
5,910,328 A * 6/1999 Oshiro et al. ..... 425/595
5,983,976 A * 11/1999 Kono ..... 164/113

FOREIGN PATENT DOCUMENTS

WO WO 97/21509 * 6/1997 ..... B22D/17/00

* cited by examiner

*Primary Examiner*—M. Alexandra Elve
*Assistant Examiner*—Kevin P. Kerns
(74) *Attorney, Agent, or Firm*—Weingarten, Schurgin, Gagnebin & Lebovici LLP

(57) ABSTRACT

A method of metering a metal material in a liquid phase in molding injection provides accurate and reliable transfer of the metal material. A heating cylinder housing a rotatable and axially movable screw, is inclined with its head pointing downward, so that the metal material in the liquid phase state flows down into a front chamber due to self-weight. At the forward position after injection, the screw is forced to retract to a set position, whereby a predetermined quantity of a liquid phase material primarily stored on the periphery of the head portion of the screw is accumulated by suction due to a negative pressure in the front chamber of the heating cylinder. Further, a constant quantity of the liquid phase material can be metered each time in the front chamber by stopping and then rotating the screw at a retraction position.

4 Claims, 3 Drawing Sheets

METERING METHOD OF METAL MATERIAL IN INJECTION MOLDING

BACKGROUND OF THE INVENTION

1. Field of the Invention

The present invention relates to a metering method of a metal material in injection molding, and more particularly to a metering method of a metal material when nonferrous metal having a low melting point, such as zinc, magnesium, or alloy thereof, is completely melted to allow injection molding in a liquid phase state.

2. Detailed Description of the Prior Art

Attempts have been made to completely melt nonferrous metal having a low melting point so as to allow injection molding in a liquid phase state. Like in the case of injection molding of a plastic material, the molding method thereof adopts a heating cylinder having inside an injecting screw, which is allowed to rotate and move along the axial direction. A granular metal material supplied from the rear portion of the heating cylinder is heated and melted completely while being transferred toward the head of the heating cylinder by means of rotation of the screw, and after a quantity of the metal material in the liquid phase state is metered in the front chamber of the heating cylinder, the metal material is injected into a mold through the nozzle attached to the tip of the heating cylinder by moving the screw forward.

A problem occurring in case of adopting the foregoing injection molding for the metal material is that the material is neither transferred readily -nor metered in a stable manner by means of rotation of the screw.

A molten plastic material has a high viscosity, and transfer of the molten plastic material by means of rotation of the screw is allowed mainly because a friction coefficient at the interface of the molten plastic material and the screw is smaller than a friction coefficient at the interface of the molten plastic material and the inner wall of the heating cylinder, and therefore, a difference in friction coefficient is produced between the two interfaces.

In contrast, the metal material, when melted completely to the liquid phase state, has such a low viscosity compared with the plastic material that a difference in friction coefficient is hardly produced between the above two interfaces. Hence, a transfer force such as the one produced with the molten plastic material by means of rotation of the screw is not readily produced.

However, a transfer force is produced with the metal material when it is in a solid state and in a high viscous region where the metal material is in a semi-molten state during the melting process. Thus, the metal material can be transferred by means of rotation of the screw up to that region. Nevertheless, as the metal material is further melted, the viscosity drops with an increasing ratio of the liquid phase, and the transfer force produced by the screw grooves between the adjacent screw flights decreases, thereby making it difficult to supply the molten metal material in a stable manner to the front chamber of the heating cylinder by means of rotation of the screw.

Because the molten plastic material has a high viscosity, it is stored in the front chamber of the heating cylinder by means of rotation of the screw, while at the same time, a material pressure that pushes the screw backward is produced as a reaction. By controlling the screw retraction caused by the material pressure, a constant quantity of the molten material can be metered each time.

However, the metal material in the low-viscous liquid phase state cannot produce a pressure high enough to push the screw backward. Thus, the screw retraction by the material pressure hardly occurs, and if the metal material is stored in the front chamber by means of rotation of the screw alone, a quantity thereof undesirably varies, thereby making it impossible to meter a constant quantity each time.

In addition, the metal material has a far larger specific gravity compared with the plastic material, and has a low viscosity and fluidity in the liquid phase state. For this reason, when allowed to stand by stopping rotation of the screw, the metal material in the liquid phase state in the heating cylinder placed in a horizontal position leaks into the semi-molten region in the rear portion through a clearance formed between the screw flights and heating cylinder. Consequently, the metal material accumulated in the front chamber causes a back flow onto the periphery of the head portion of the screw through the opened ring valve, and the quantity thereof is undesirably reduced.

The liquid level in the front chamber is lowered with the decreasing accumulated quantity. For this reason, a gaseous phase (space) that makes the metering unstable is generated at the upper portion of the front chamber. In addition, the leaked liquid phase material increases its viscosity in the semi-molten region as its temperature drops,or turns into solid depending on the heating condition in the semi-molten region, thereby forming weirs in the screw grooves. This poses a problem that the granular material supplied from the supply port provided behind the weir cannot be transferred readily by means of rotation of the screw.

SUMMARY OF THE INVENTION

The present invention is devised to solve the above problems raised with injection molding of a metal material in the liquid phase state, and therefore, has an object to provide a novel metering method of a metal material in injection molding, by which the metal material in the liquid phase state can be transferred, metered, and deaerated smoothly at all times by placing a heating cylinder in an inclined position, forcing a screw to retract, etc.

In order to achieve the above and other objects, the present invention is a metering method of a metal material in injection molding adapted to employ a heating cylinder provided with a nozzle at a tip thereof and a supply port at a rear portion thereof and having inside a screw, which is allowed to rotate and move along an axial direction, for melting the metal material in the heating cylinder to be transferred to and metered in a front chamber of the heating cylinder in a liquid phase state, and then injecting the metal material through the nozzle by moving the screw forward, and the method includes: placing the heating cylinder in an inclined position with a head thereof pointing downward, so that the metal material in the liquid phase state flows down into the front chamber due to self-weight; forcing the screw at a forward position after injection to retract to a set position while maintaining an inclination, thereby accumulating by suction a predetermined quantity of a liquid phase material stored primarily on a periphery of a head portion of the screw in the front chamber of the heating cylinder by means of a negative pressure; and stopping and then rotating the screw at a retraction position, thereby metering each time a constant quantity of the liquid phase material in the front chamber.

A sensor for counting the number of revolutions of the screw may be provided so as to control the number of revolutions of the screw to stay at a set number of revolutions by means of the sensor. Further, the screw may include an injecting plunger at the tip thereof, which has substantially a same diameter as a diameter of the front chamber formed in the heating cylinder at a top end portion by reducing a diameter thereof so as to be allowed to fit into the front chamber by moving forward and backward while securing a sliding clearance such that hardly causes a back flow of the liquid phase material in the front chamber.

According to the metering method of the present invention, the metal material in the liquid phase state stored primarily on the periphery of the head portion of the screw is accumulated by suction in the front chamber of the heating cylinder by means of a negative pressure produced when the screw is forced to retract. Hence, the metal material can be transferred to the front chamber more readily and reliably compared with transfer by means of screw grooves formed between the adjacent screw flights.

Also, because the heating cylinder is inclined with its head pointing downward so that the metal material is accumulated in the front chamber, an accumulation quantity does not vary due to a back flow even when the metal material is in the low-viscous liquid phase state. In addition, the metal material in the liquid phase state can be stored primarily, and an accumulation quantity in the front chamber can be compensated by means of subsequent rotation of the screw. Hence, a product made of a metal material with a stable molding state can be obtained even by injection molding of the metal material in the liquid phase state.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

The following description will describe the present invention in detail with reference to the accompanying drawings.

Figure 1:
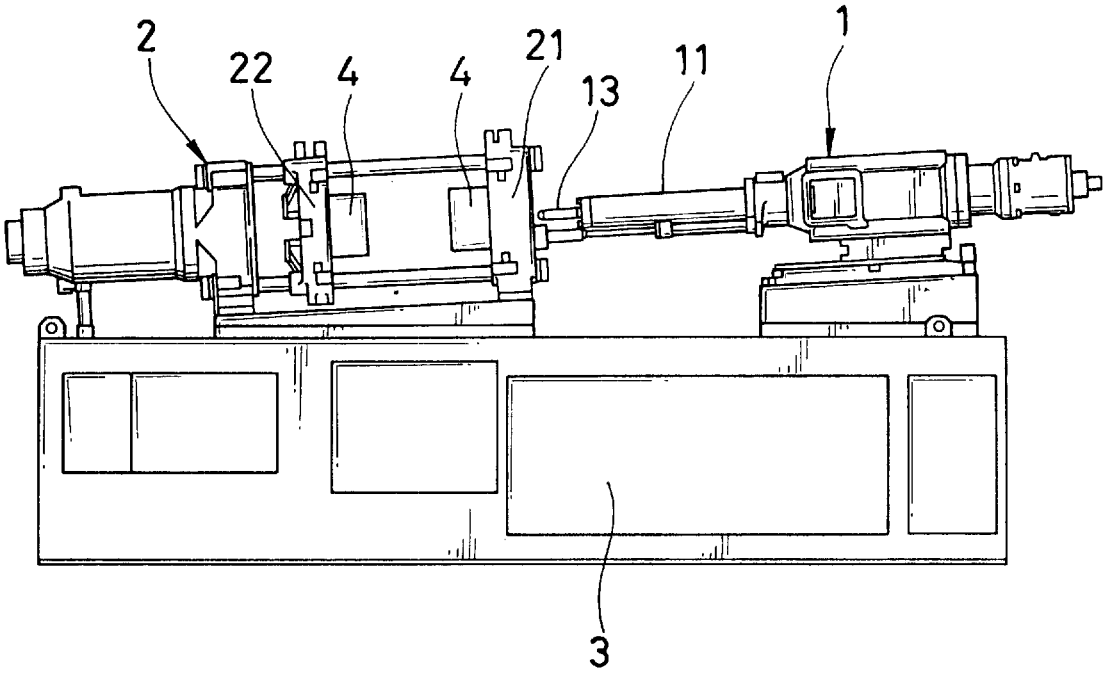
FIG. 1 is an elevation of an injection molding apparatus of a metal material employed in one embodiment of a metering method of the present invention.

FIG. 1 shows an example of an injection molding apparatus employed in one embodiment of the present invention. In the drawing, reference numeral 1 denotes an in-line screw type injection apparatus, and reference numeral 2 denotes a clamping apparatus of a typical known type forming a pair with the injection apparatus 1. Also, a pair of split type metal molds 4 are provided to a stationary platen 21 and a movable platen 22 of the clamping apparatus 2, respectively.

Figure 2A:
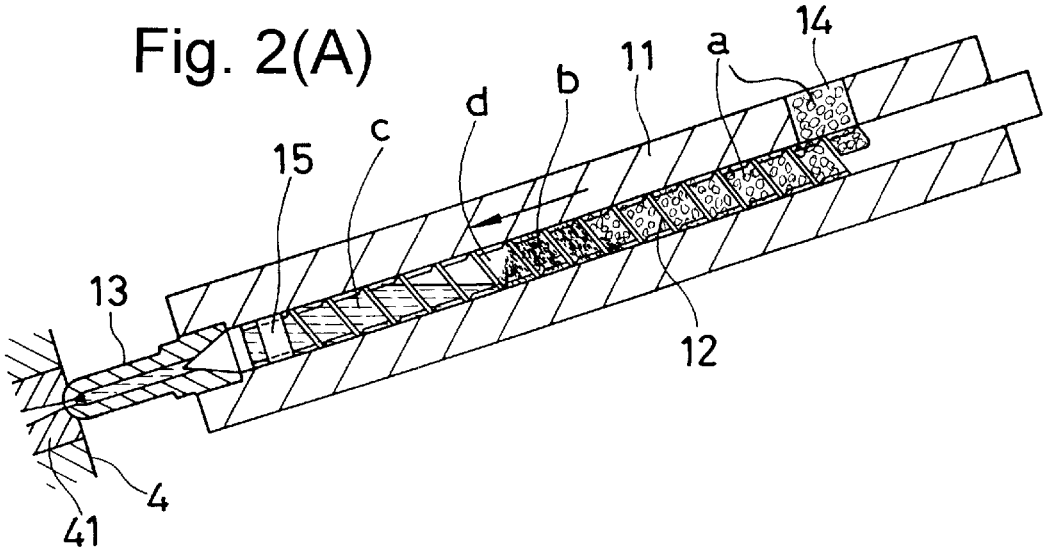
FIGS. 2(A), 2(B) and 2(C) are schematic explanatory views showing a major portion of the injection apparatus detailing the metering method of the present invention step by step.
Figure 2B:
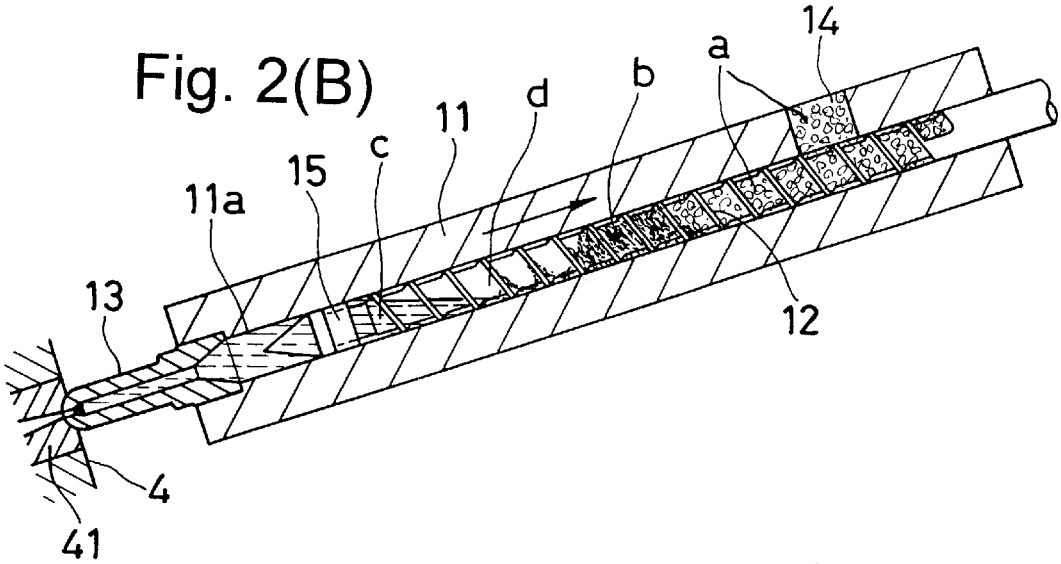

As schematically shown in FIGS. 2(A) to 2(B), the injection apparatus 1 includes a heating cylinder 11, which is fabricated by attaching band heaters (not shown in the drawing) at regular intervals on the outer periphery of the cylinder, and an injecting screw 12, which is housed in the heating cylinder 11 and allowed to rotate and move along the axial direction. The heating cylinder 11 also has a nozzle 13 at the tip thereof and a supply port 14 of a granular metal material at the rear portion thereof. The heating cylinder 11 is placed in an inclined position with the nozzle 13 pointing downward and the supply port 14 facing upward, so that the molten metal in the liquid phase state in the heating cylinder 11 flows down into the front chamber due to self-weight.

The screw 12 is of a typical known type, and a back-flow preventing ring valve 15 is fitted into the outer circumference of the top end portion shaped in a cone in such a manner that it is allowed to move forward and backward. The screw 12 does not have a compressing section, and is formed in such a manner that flights are formed in spiral on the periphery of the axis portion having a constant diameter so that screw grooves at predetermined pitches are formed between the adjacent flights, by which the granular metal material supplied from the supply port 14 is transferred toward the head of the heating cylinder 11 by means of rotation of the screw 12.

The above-arranged injection apparatus 1 and clamping apparatus 2 are placed on an apparatus platform 3 in an inclined position at the same angle (inclination angle of at least 3 degrees) with the metal molds 4 at the lower end, so that the metal material in the liquid phase state in the heating cylinder 11 flows down into a front chamber 11*a* of the heating cylinder 11 due to self-weight, and that the nozzle 13 and a sprue bush 41 inside the mold 4 are positioned and aligned on the same straight line, thereby maintaining the nozzle touch without bending the nozzle 13.

It should be appreciated that the present invention can be attained by placing the injection apparatus 1 alone in an inclined position, and therefore, the present invention is not limited to the arrangement such that both the injection apparatus 1 and clamping apparatus 2 are placed in an inclined position at the same angle like in the present embodiment.

FIG. 2(A) is a view schematically showing the molten state of the metal material at the forward position of the screw 12 after injection. Here, the metal material turns from a granular material a to a semi-molten material band to a liquid phase material c from the rear to the head. Initially, the metal material in the form of the granular material a is guided successively by the screw 12 and transferred toward the head of the heating cylinder 11 by means of rotation of the screw 12 during metering. On the way to the head, the granular material a starts to melt by heating from the external and turns to the semi-molten material b in the mixed state having both the solid phase and liquid phase.

When heated further, the liquid phase ratio in the semi-molten material b increases and only the liquid phase material c having a viscosity as low as that of hot water is readily collected below the screw 12 due to self-weight. However, in addition to a transfer effect attained by rotation of the screw 12, because the heating cylinder 11 is inclined with its head pointing downward and so is the screw 12, the liquid phase material c flows down on the periphery of the head portion of the screw 12 and is accumulated so as to increase its depth. At the same time, deaeration is conducted spontaneously.

At the interface between the semi-molten material b and liquid phase material c, a gaseous phased is produced. Because the semi-molten material b is positioned upper than the liquid level that faces the gaseous phase d in a horizontal position, even when the liquid phase material c is allowed to stand by stopping the rotation of the screw 12, the liquid phase material c does not leak to the semi-molten material b side, thereby preventing unwanted variance in an accumulation quantity in the front chamber 11*a*.

FIG. 2(B) shows a state when the liquid phase material c stored on the periphery of the head portion of the screw 12 is metered by supplying the same forcibly into the front chamber 11*a* of the heating cylinder 11. The metering is conducted by forcing the screw 12 at the forward position after injection to retract for a set distance without rotation while maintaining the nozzle touch between the nozzle 13 and sprue bush 41 inside the mold 4.

Because the tip of the nozzle 13 is clogged with the cooled and solidified material used for the preceding injection, the forced retraction of the screw 12 produces a negative pressure state (decompressed or vacuum state) in the front chamber 11*a* of the heating cylinder 11. Hence, the closed ring valve 15 is pulled back and opened, whereupon the liquid phase material c stored primarily on the periphery of the head portion of the screw 12 starts to flow into the front chamber 11*a* by suction to be accumulated therein. This suction has little effect on the semi-molten material because of the gaseous phased produced at the interface between the semi-molten material b and liquid phase material c, and expands the gaseous phase d.

In case of the accumulation by suction, air in the gaseous phase d may be contained in the liquid phase material c depending primarily on an accumulation quantity of the same. Also, a quantity of the liquid phase material c stored primarily on the periphery at the head portion of the screw 12 may decrease, which possibly causes a shortage in the following metering. Therefore, it is preferable to replenish and deaerate the liquid phase material c by means of rotation of the screw 12.

Figure 2C:
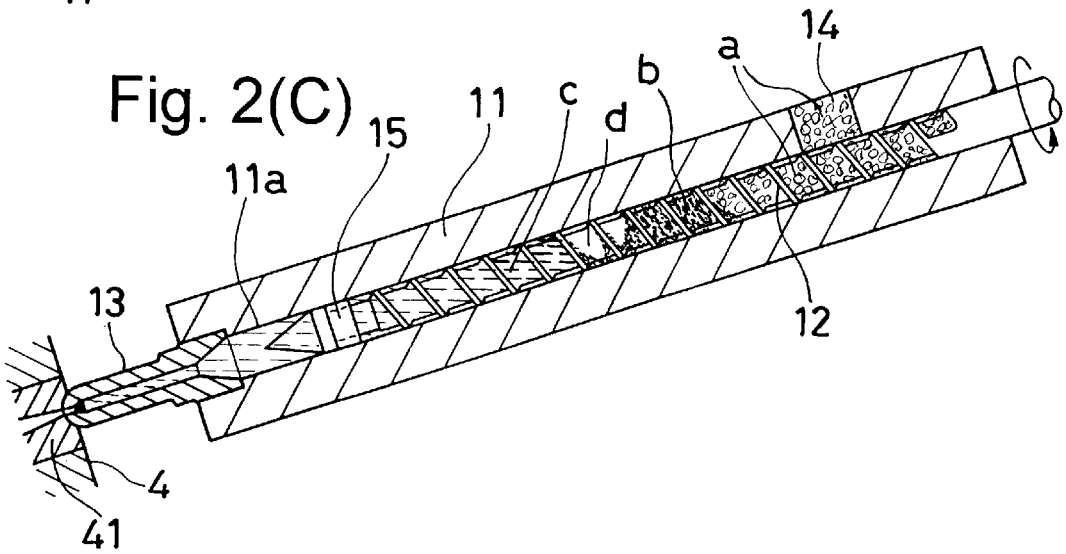

FIG. 2(C) shows such a replenishing state. That is, when the screw 12 is retracted to a preset position, the screw 12 is stopped and then started to rotate at that position. By this rotation, the granular material a at the rear portion of the screw 12 is transferred toward the head and turns into the semi-molten state. In addition, the semi-molten material b in the head is further melted while being transferred and heated, and turns into the liquid phase state. Consequently, the molten metal material is additionally stored on the periphery of the head portion of the screw 12, thereby increasing the accumulation quantity of the liquid phase material c. Also, if there is a shortage in the liquid phase material c accumulated in the front chamber 11*a*, the shortage is compensated, so that metering can be conducted in a stable manner each time. In addition, deaeration can be conducted due to self-weight of the material.

A primarily accumulation quantity of the liquid phase material c varies with the number of revolutions (rpm) of the screw 12 and a rotation time (sec). Therefore, it is preferable to control the number of revolutions (rpm) of the screw 12 to stay at a set number of revolutions by counting the number of revolutions of the screw 12 by means of a sensor. More specifically, a predetermined number of revolutions since the rotation of the screw 12 started is counted by a revolution counter (sensor) employed in a typical molding apparatus, and the number of revolutions is found by computing the number of revolutions (rpm) of the screw 12 multiplied by a rotation time (sec), so that the number of revolutions of the screw 12 will stay at the set number of revolutions.

In order to prevent the retraction of the screw 12 during rotation, it is preferable to apply a back pressure to some extent while the screw 12 is rotating.

When the replenishment by means of rotation of the screw 12 is completed, the rotation of the screw 12 is stopped, and the step is switched to the injecting step. Then, the liquid phase material c metered in the front chamber 11*a* is injected into the molds 4 by moving the screw 12 forward by means of process control.

The solidified material clogging the tip of the nozzle 13 is pushed out into the molds 4 by an injecting pressure at the injection, and therefore, does not cause any trouble when injecting and filling the liquid phase material c accumulated in the front chamber 11*a*. In this manner, the screw 12 moves and reaches the injection completion position shown in FIG. 2(A), whereupon injection is completed. Then, the step is switched back to the metering step for the following metering, and the screw 12 is forced to retract.

In case of molded products each requiring a small injection quantity, a series of shots can be conducted at one time by setting a primarily accumulation quantity of the liquid phase material c to a large value. In this case, the screw 12 does not have to be rotated for each shot, but for each series of shots.

Figure 3:
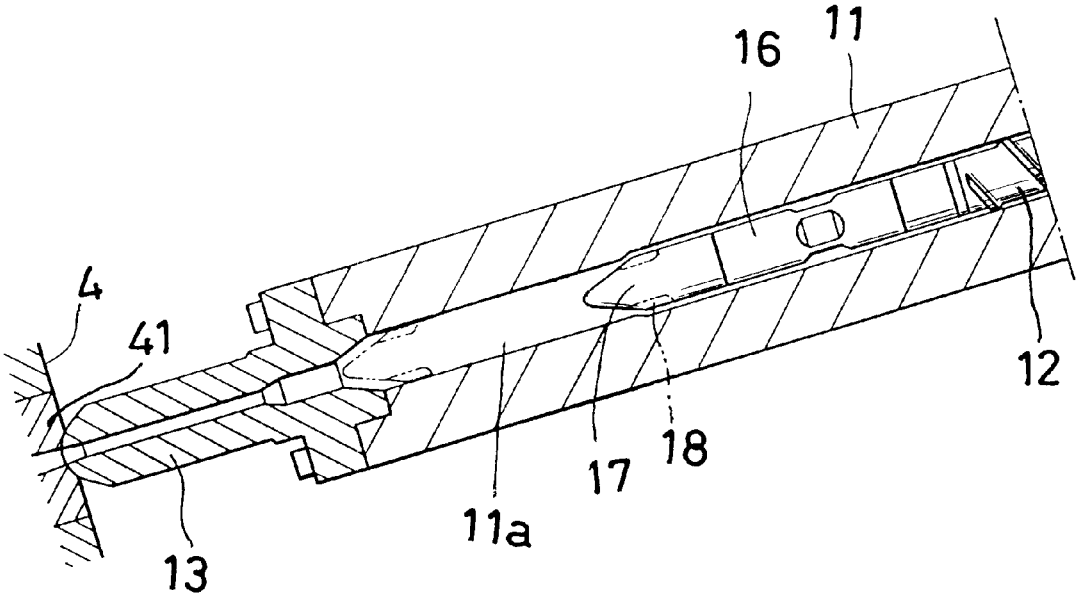
FIG. 3 is a longitudinal section of a top end portion of an injection apparatus equipped with a screw omitting a ring valve in accordance with another embodiment of the present invention.

FIG. 3 shows another embodiment of an injection apparatus provided with a screw 12 omitting the ring valve 15 and instead including an injecting plunger at the tip thereof.

In a heating cylinder 11 of this injection apparatus, a front chamber 11*a* for metering is formed by reducing the inner diameter of the top end portion for a required length by 8 to 15% with respect to the inner diameter of the heating cylinder 11. It should be appreciated that the heating cylinder 11 includes a nozzle 13 at the tip in the same manner as the above embodiment.

The screw 12, which is housed in the heating cylinder 11 and allowed to rotate and move along the axial direction, is equipped with an injecting plunger 16 at the tip thereof. The diameter of the plunger 16 is substantially the same as the diameter of the front chamber 11*a*. According to this arrangement, the plunger 16 is allowed to fit into the front chamber 11*a* by moving forward and backward while securing a sliding clearance such that hardly causes a back flow of the liquid phase material c accumulated in the front chamber 11*a* of FIG. 3.

Also, a top end portion 17 of the plunger 16 is shaped in a cone with a tapered surface so as to fit into a funnel shape of the top end portion of the front chamber 11*a*. A plurality of concave channel grooves 18 are provided at regular intervals across the tapered surface and the head portion of the axis portion. The channel grooves 18 are not essential, and can be omitted if the retraction position of the screw 12 is set behind the one illustrated in the drawing and a channel space is formed on the periphery of the top end portion 17.

The screw 12 moves forward in the front chamber 11*a* until the top end portion 17 of the plunger 16 reaches the filling completion position by means of process control, and a full quantity of the liquid phase material c metered in the front chamber 11*a*, except for a required amount of the liquid phase material c used as a cushion, is injected into a pair of metal molds 4.

The metering of the material after the injection is conducted by forcing the screw 12 at the forward position after injection to retract for a set distance without rotation while maintaining the nozzle touch between the nozzle 13 and sprue bush 41 inside the mold 4.

Because the tip of the nozzle 13 is clogged with the cooled and solidified material used for the preceding injection, the forced retraction of the screw 12 produces a negative pressure state (decompressed or vacuum state) in the front chamber 11*a* of the heating cylinder 11. Hence, the liquid phase material c stored primarily on the periphery of the head portion of the screw 12 flows into the front chamber

11*a* by suction to be accumulated therein. The steps thereafter are the same as those in the above embodiment explained with reference to FIG. 2, and the detailed description of these steps is omitted for ease of explanation.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A metering method of a metal material in injection molding employing a single heating cylinder having a tip, a front chamber, and a rear portion, a nozzle disposed at the tip and a supply port of a granular metal material disposed at the rear portion, a screw disposed inside the heating cylinder, the screw operative to rotate and move along an axial direction, for melting the metal material in said heating cylinder to be transferred to and metered in said front chamber of said heating cylinder in a liquid phase state, and then injecting the metal material from said front chamber through said nozzle by moving said screw forward, said method comprising the steps of:

placing said single heating cylinder in an inclined position with a head thereof pointing downward, and operating said single heating cylinder so that the metal material turns from a granular material to the liquid phase state and, in the liquid phase state, flows down into said front chamber due to self-weight;

forcing said screw, at a forward position after injection, to retract to a set position without rotation while maintaining an inclination, thereby accumulating a predetermined quantity of a liquid phase material in said front chamber of said heating cylinder, the accumulation due to suction from a negative pressure in said front chamber acting on the liquid phase material stored primarily on a periphery of a head portion of said screw; and stopping the retraction of said screw, then rotating said screw at a retracted position, thereby metering a constant quantity of the liquid phase material in said front chamber, whereby the constant quantity can be repetitively metered during subsequent metering operations.

2. The metering method of a metal material in injection molding according to claim 1, wherein a sensor for counting a number of revolutions of said screw at the retracted position is provided, and the number of revolutions of said screw is controlled to stay at a set number of revolutions by means of said sensor.

3. The metering method of metal material in injection molding according to claim 2, wherein:

said screw includes an injecting plunger at the tip thereof; and said plunger has substantially a same diameter as a diameter of said front chamber formed in said heating cylinder at a top end portion by reducing a diameter of said heating cylinder, said plunger configured to fit into said front chamber during forward and backward motion with a sliding clearance that does not cause a back flow of the liquid phase material in said front chamber.

4. The metering method of metal material in injection molding according to claim 1, wherein:

said screw includes an injecting plunger at the tip thereof; and said plunger has substantially a same diameter as a diameter of said front chamber formed in said heating cylinder at a top end portion by reducing a diameter of said heating cylinder, said plunger configured to fit into said front chamber during forward and backward motion with a sliding clearance that does not cause a back flow of the liquid phase material in said front chamber.

* * * * *

UNITED STATES PATENT AND TRADEMARK OFFICE

CERTIFICATE OF CORRECTION

PATENT NO. : 6,588,486 B1
DATED : July 8, 2003
INVENTOR(S) : Kazutoshi Takayama et al.

It is certified that error appears in the above-identified patent and that said Letters Patent is hereby corrected as shown below:

Column 4,
Line 38, “band to a” should read -- b and to a --; and

Column 5,
Line 18, “material because” should read -- material b because --.

Signed and Sealed this

Nineteenth Day of October, 2004

JON W. DUDAS
*Director of the United States Patent and Trademark Office*